US010220923B2

(12) United States Patent
Danneberg et al.

(10) Patent No.: US 10,220,923 B2
(45) Date of Patent: Mar. 5, 2019

(54) FIN STABILIZER, COVERING ELEMENT AND WATER VEHICLE

(71) Applicant: SKF Marine GmbH, Hamburg (SE)

(72) Inventors: Kai Danneberg, Hamburg (DE); Michael Zollenkopf, Hamburg (DE); Frank Albrecht, Stadtoldendorf (DE); Ulrich Albrecht, Stadtoldendorf (DE); Uwe Leitloff, Wennigsen (DE); Thomas Siebrecht, Elmshorn (DE); Holger Spardel, Hamburg (DE)

(73) Assignee: SKF Marine GmbH, Hermann-Blohm-Straße (DE)

( * ) Notice: Subject to any disclaimer, the term of this patent is extended or adjusted under 35 U.S.C. 154(b) by 0 days.

(21) Appl. No.: 15/519,590

(22) PCT Filed: Oct. 22, 2015

(86) PCT No.: PCT/EP2015/074469
§ 371 (c)(1),
(2) Date: Apr. 17, 2017

(87) PCT Pub. No.: WO2016/062803
PCT Pub. Date: Apr. 28, 2016

(65) Prior Publication Data

US 2017/0247090 A1 Aug. 31, 2017

(30) Foreign Application Priority Data

Oct. 24, 2014 (DE) ..... 10 2014 221 606

(51) Int. Cl.
*B63B 39/06* (2006.01)
*B63B 43/04* (2006.01)

(52) U.S. Cl.
CPC ..... *B63B 39/06* (2013.01); *B63B 2039/068* (2013.01)

(58) Field of Classification Search
CPC ..... B63B 39/06; B63B 2039/06; B63B 2039/063; B63B 2039/065;
(Continued)

(56) References Cited

U.S. PATENT DOCUMENTS 3,788,257 A * 1/1974 Miller ..... B63B 41/00 114/102.22
6,782,839 B1 * 8/2004 Nozaki ..... B63B 1/20 114/280

(Continued)

FOREIGN PATENT DOCUMENTS

DE 2534915 A1 3/1976
DE 102011005312 A1 9/2012

(Continued)

*Primary Examiner* — Daniel V Venne
(74) *Attorney, Agent, or Firm* — Bryan Peckjian; SKF USA Inc. Patent Dept.

(57) ABSTRACT

A fin stabilizer for stabilizing watercraft includes a pivotable stabilizer fin and a receiving space for receiving the stabilizer fin. The stabilizer fin is shiftable from a retracted state in which the stabilizer fin is received in the receiving space to an extended state in which the stabilizer fin extends from the receiving space. Also at least one flexible cover element for at least partially covering an opening of the receiving space, through which opening the stabilizer fin enters and exits the receiving space during retracting and extending, respectively. The stabilizer fin does not contact the at least one cover element when shifting from the retracted state to the extended state.

19 Claims, 10 Drawing Sheets

(58) Field of Classification Search
CPC ..... B63B 2039/066; B63B 2039/067; B63B 2039/068; B63B 41/00; B63B 2041/00; B63B 2041/003; B63B 2041/006
USPC ..... 114/271, 274, 278, 280, 282
See application file for complete search history.

(56) References Cited

U.S. PATENT DOCUMENTS

| | | | | |
|---|---|---|---|---|
| 7,434,527 | B2 * | 10/2008 | Brighi | B63B 39/06 114/126 |
| 2007/0137543 | A1 * | 6/2007 | Brighi | B63B 39/06 114/152 |

FOREIGN PATENT DOCUMENTS

| | | | |
|---|---|---|---|
| EP | 2096027 | A2 | 9/2009 |
| GB | 760792 | A | 11/1956 |
| JP | H0162191 | U | 4/1989 |
| JP | H0381198 | U | 8/1991 |

* cited by examiner

FIN STABILIZER, COVERING ELEMENT AND WATER VEHICLE

CROSS-REFERENCE

This application is the U.S. National Stage of International Application No. PCT/EP2015/074469 filed on Oct. 22, 2015, which claims priority to German patent application no. 10 2014 221 606.0 filed on Oct. 24, 2014.

TECHNOLOGICAL FIELD

The invention relates to a fin stabilizer for the stabilizing of watercraft, a cover element, and a watercraft.

BACKGROUND

Fin stabilizers serve to dampen rolling movements of watercraft or ships. In principle there are two types of fin stabilizers. Fin stabilizers including stabilizer fins retractable into the hull, and fin stabilizers including non-retractable stabilizer fins. The present invention relates to the fin stabilizers including a retractable stabilizer fin. For this purpose the fin stabilizers have a receiving space or fin box that is introduced into the hull and open to the water side via an opening. The fin box is sealed with respect to the hull interior. During retracting and extending the stabilizer fin enters or exits through the opening in the fin box. The opening is slightly larger than the cross-section of the stabilizer fin. In operation water is pressed or sucked into the fin box and impinges with high speed on a rear side wall, viewed in the direction of travel of the ship, of the fin box. In addition, a relatively strong circulation flow forms inside the fin box. A large flow resistance is thereby induced, which significantly increases the fuel consumption of the ship. Furthermore the maximum buoyancy-force and downthrust-force and thus the stabilization performance of the fin stabilizer is impaired by the fin-box opening.

For this reason covers have been developed for at least partial covering or closing of the opening. In one cover a stiff metal plate as cover element is deflected in the edge region of the opening and is pivotable via a mechanical drive. In DE 10 2011 005 312 A1 a cover is shown whose cover element is formed by a dimensionally stable tail fin of the stabilizer fin. For this purpose the stabilizer fin is correspondingly pivotable in the fin box, and the tail fin is correspondingly adjustable relative to the stabilizer fin. While the use of the tail fin as cover element requires no additional cover element or drive, an at least partial covering of the opening is, however, not possible with extended stabilizer fin.

In the publication DE 25 34 915 A1 a device for the stabilizing of ships is shown. For receiving the stabilizer fin in the rest position the device includes a fin-shaft housing including a slot as extension through which the stabilizer fin is extended and retracted. Here a plate for covering the fin-shaft housing is disposed on the stabilizer fin itself. In the use position of the stabilizer fin the plate covers the fin-shaft housing. In the rest position of the stabilizer fin a second plate can cover the fin-shaft housing. The slot remains uncovered independent of the position of the stabilizer fin.

Further prior art is known, for example, from GB 760 792 A and EP 2 096 027 A2.

An object of the invention is to provide a fin stabilizer that allows, with a reduced expense in terms of device technology, an at least partial covering of its fin-box opening both in the retracted and in the extended state of the stabilizer fin. Furthermore, it is an object of the invention to provide a cover element for such a fin stabilizer and a watercraft such that the watercraft has a high rolling damping and a lower fuel consumption.

An inventive fin stabilizer for stabilizing of watercraft has a pivotable stabilizer fin, a receiving space for receiving of the stabilizer fin in the retracted state, and at least one cover element for at least sectional covering of an opening of the receiving space, through which the stabilizer fin enters in the receiving space or exits during retracting and extending. According to the invention the at least one cover element is flexible.

Since the at least one cover element is flexible it can be pushed away from the stabilizer fin during extending or retracting, or reduced by the water pressure surrounding it for extending or retracting. Since the cover is not formed by a tail fin, it makes possible an at least partial closing of the opening even in the extended state of the stabilizer fin. Thus in operation a smoother hull is provided in the region of the stabilizer fin than with a completely open receiving space, i.e., a nearly continuous hull, whereby a more undisturbed flow is achieved. The buoyancy of the stabilizer fin is thus increased and a correspondingly high stabilizing performance is achieved. At the same time the flow resistance is significantly reduced by the nearly smooth hull in the region of the stabilizer fin, whereby the fuel consumption turns out significantly lower than with watercraft including open fin boxes in operation. Due to the greater buoyancy the efficiency of the fin stabilizer is increased with simultaneous resistance reduction.

In one exemplary embodiment the at least one cover element extends over the respective height of the opening or nearly over the respective height of the opening. Thus only one cover element is required. For example, the cover element is attached to an upper opening edge and protrudes in the closed position up to the lower opening edge.

Alternatively at least one second cover element can be provided that in combination with the at least one cover element extends over the respective height of the opening or nearly over the respective height of the opening. The second cover element is fastened, for example, on the lower opening edge and extends toward the upper opening edge. The at least one cover element is then fastened on the upper opening edge and extends toward the lower opening edge. The cover elements can have the same height and thus meet at virtually half the height of the opening or form a contact region at half the height of the opening. Of course the cover elements can also have different heights and, for example, the upper cover element can be taller than the lower cover element. The height of the cover elements preferably conforms to the position of the stabilizer fin in the put-away or retracted or extended state.

In one alternative exemplary embodiment including at least one second cover element, in the retracted state the cover elements abut on opposing sides of the stabilizer fin. In this exemplary embodiment the cover elements form no contact region between each other, rather each cover element forms its own contact region with one side of the stabilizer fin. In the retracted state the stabilizer fin is thus not completely covered by the cover elements, but rather protrudes out between them with a section, wherein the receiving space is closed by the opposing abutting or contact regions of the cover elements on the stabilizer fin. This exemplary embodiment allows a greater tolerance range with respect to the orientation and shape of the cover elements with respect to each other, since installation- and component-tolerances can be compensated by the respective abutting on the stabilizer fin in the retracted state. In addition, it can be advantageous in terms of a lower space requirement with, for example, retrofits.

In one exemplary embodiment the at least one cover element and/or the at least second cover element is/are an inherently stable and elastic plastic lip. In this purely passive variant any drive is eliminated. With extending of the stabilizer fin the at least one plastic lip is pushed away by it and correspondingly elastically deformed. Due to the lack of drive this variant is very low-maintenance. Natural rubber or a rubber material is preferably selected as material for the plastic lip. "Inherently stable" means that with lower attachment the plastic lip supports itself and does not bend away, thus requires no support framework. "Elastic" means ideally elastic and thus with a return into its original shape after an elastic deforming.

In one alternative exemplary embodiment the at least one cover element and/or the at least second cover element is/are an elastic plastic lip that is/are stabilized by at least one elastic or volume-variable support element. In this variant the plastic lips can be thinner and thus more easily embodied than the inherently stable and elastic plastic lips, since the stability is achieved by the local support elements. Tighter bends are thus possible than in the previous exemplary embodiment, with the result that this can be used in particular in the fin stabilizers that have a very narrow gap between the stabilizer fin and the upper and lower opening edge during retracting and extending. For example, for elastic support elements metallic spring plates or spring strips are attached rear-side on the at least one plastic lip or embedded therein. A further example are flexible support fibers made from carbon fibers or glass fibers that are embedded into the at least one plastic lip. One example for volume-variable support elements are hollow-chamber ribs that are depressurized during retracting and extending and are pressurized and thus stiffened for closing with a gaseous or liquid fluid or pressure medium such as compressed air, for example, via an already available onboard network. Due to a water pressure abutting on the hollow-chamber ribs their depressurization can be effected automatically with pressurization with compressed air. The compressed air thus need not be actively sucked away.

In a further exemplary embodiment the at least one cover element and/or the at least second cover element includes/include a plurality inherently stable and elastic bristle- or lamella-type elements. This variant is also purely passive. The bristle- or lamella-type elements can be lamella-type, bristle-type, barbel-type and the like.

In another exemplary embodiment the at least one cover element and/or the at least second cover element is/are a volume-variable hollow-chamber lip. The at least one hollow-chamber lip is pressurized with a fluid or pressure medium such as air, water, oil, and the like for at least partial covering of the opening, and depressurized for retraction and extension and thus pressed together. In particular when the hollow-chamber lip is pressurized with compressed air the depressurization can be effected automatically via the externally abutting water pressure, i.e., passively. In principle, however, an active sucking away of the air such as preferably with a liquid pressure medium is also possible. However, with the sucking away the externally abutting water pressure can be considered supporting. With this variant a strong elastic deforming does not occur with retracting and extending. However, the point in time of extending and retracting of the stabilizer fin can be set such that the stabilizer fin only retracts or extends a certain pressed-out or discharged fluid amount from the at least one hollow-chamber lip. Possible leaks in the hull of the hollow-chamber lip can be immediately recognized via pressure fluctuations during the pressurizing in the at least partially closed state. Expensive inspection work, which can only be carried out in dry dock, is thus omitted.

In order to achieve an optimal at least partial covering of the opening, the at least one hollow-chamber lip includes at least one flexible and high-tensile-strength shaping element. A high dimensional- and thus fit-precision of the at least one seal lip is achieved by the tensile strength. The flexibility makes it possible that the at least one hollow-chamber lip is nonetheless compressible or foldable. Examples of such a shaping element are fabric sheets that extend in the interior of the at least one hollow-chamber lip and make possible via holes a pressure equalization between the chambers formed by them.

To protect the at least one hollow-chamber lip from damage by the stabilizer fin a robust and simultaneously elastic or flexible belt element, such as, for example, a conveyor band, can be disposed between the stabilizer fin and the hollow-chamber lip. The at least one hollow-chamber lip is thus protected from direct physical contact with the stabilizer fin. Simultaneously the at least one belt element can serve as a guide for the at least one hollow-chamber lip. In order to ensure a reliable guiding of the hollow-chamber lip out of the fin-box opening with a steep installation position of the respective fin box, the respective belt element can be stiffened by a reinforcement.

In one preferred exemplary embodiment the at least one first cover element includes at least one buoyancy body for generating a buoyancy. The folding, retracting, or extending of the upper hollow-chamber lip from the fin-box opening can thereby be accelerated independent of the installation position of the fin box.

According to one further exemplary embodiment of the device the at least second cover element is weighted by at least one downward force providing elementfor generating a downward force. A folding together or pivoting-out of the hollow-chamber lip is accelerated by the downward force providing element during opening of the fin box. It can thereby also be ensured that the cover element reliably escapes from the opening region and thus from the pivot path of the stabilizer fin.

In one further exemplary embodiment of the device the fin box includes in the upper edge region an upper receiving space for receiving an upper cover element and/or, in the lower edge region, a lower receiving space for receiving a lower cover element. In the opened state of the fin box the receiving elements are thereby securely protected from external damage.

An inventive cover element for a fin stabilizer is flexible. It is thus not rigid, stiff, but rather elastic, in particular ideally deformable, flexible, volume-variable, and the like. Due to the flexibility, device-technical expensive articulation or movement mechanisms for opening or closing the cover element during extending and retracting of a stabilizer fin are omitted.

An inventive watercraft is a ship and has at least one inventive fin stabilizer. Such a ship has a high roll damping and a lower fuel consumption than ships with open fin boxes in operation.

In the following, preferred exemplary embodiments of the invention are explained in more detail with reference to greatly simplified schematic illustrations.

DETAILED DESCRIPTION

Figure 1:
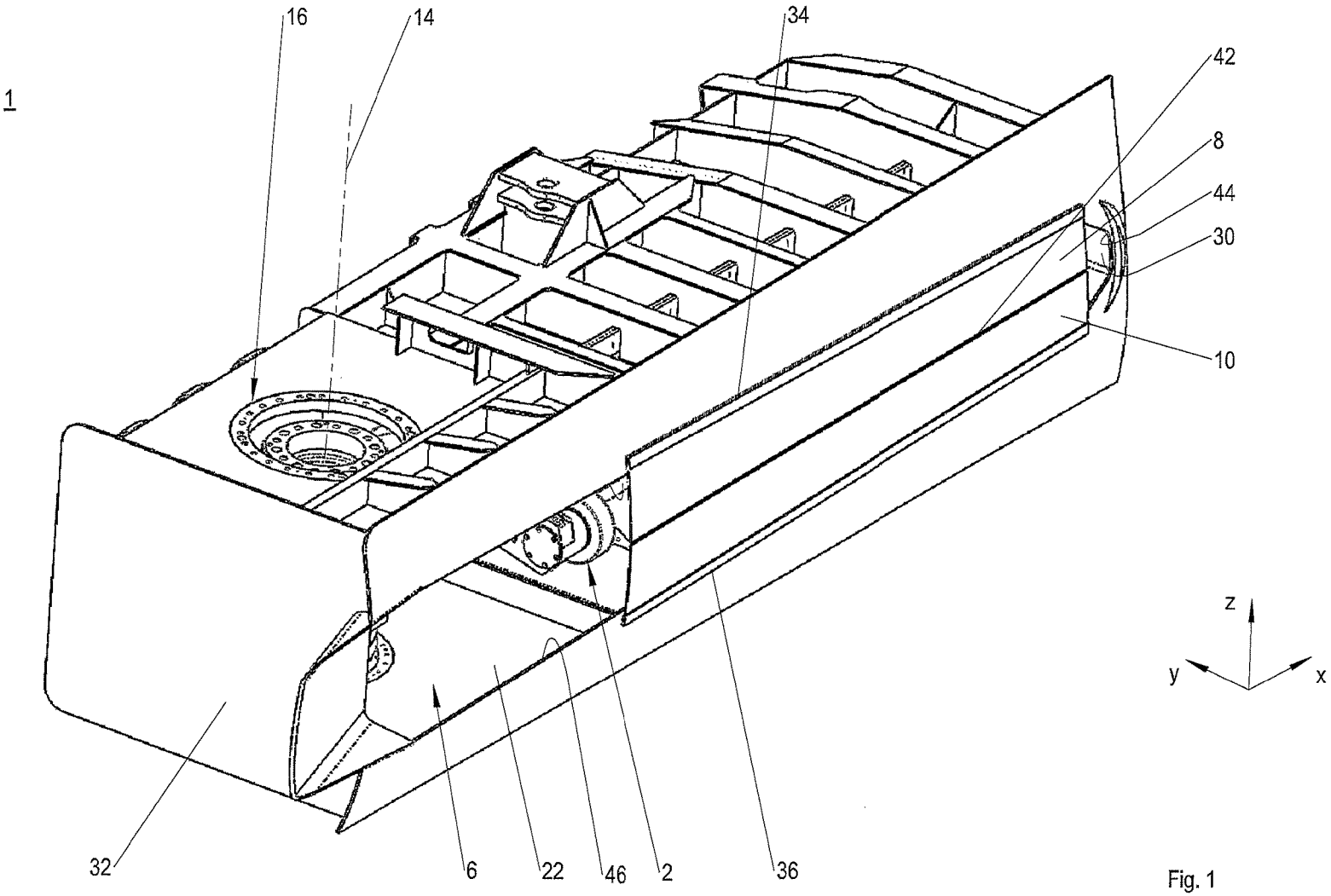
FIG. 1 shows a perspective depiction of a first exemplary embodiment of an inventive fin stabilizer with retracted stabilizer fin.
Figure 2:
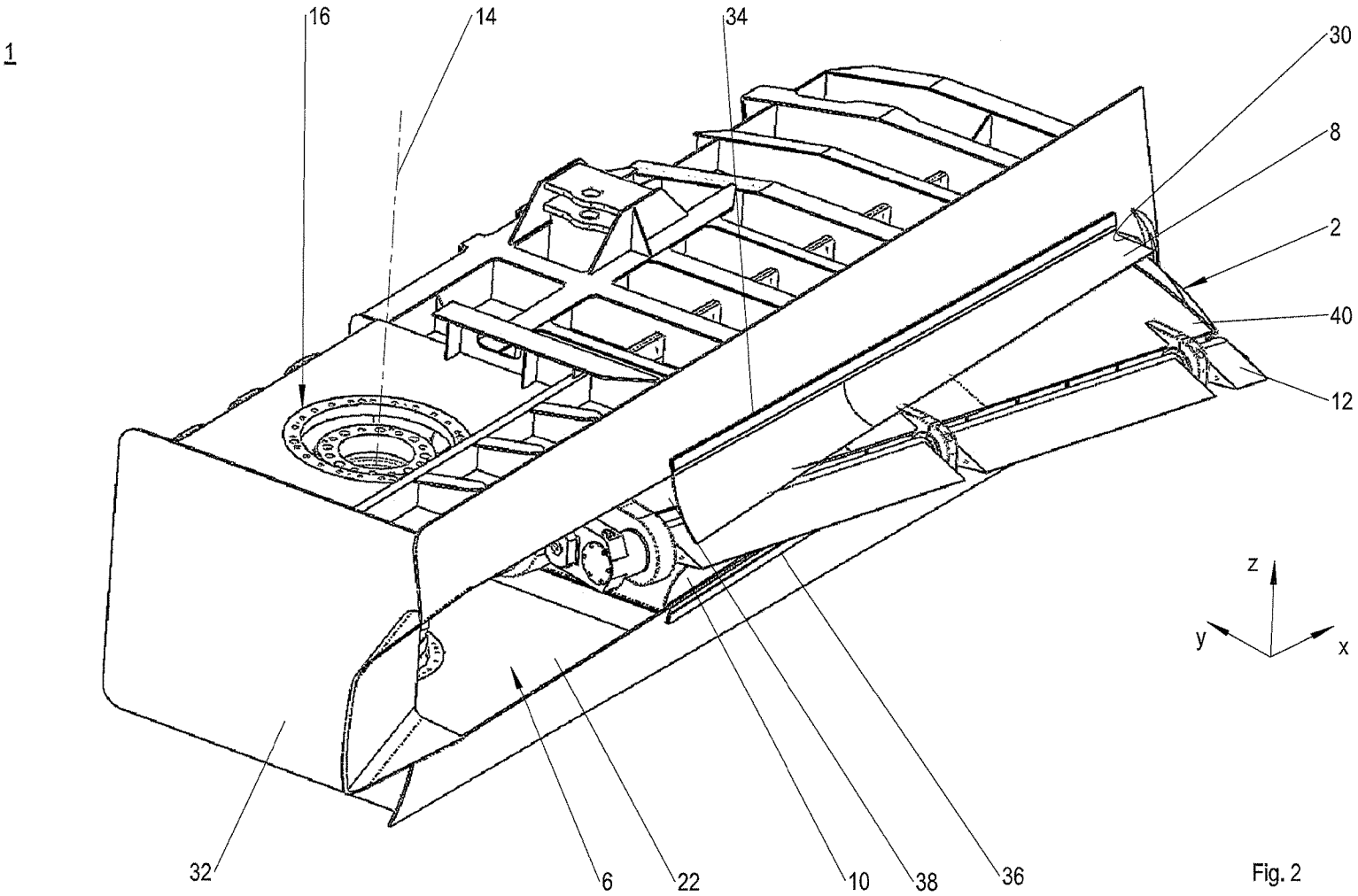
FIG. 2 shows a perspective depiction of the first exemplary embodiment with extended stabilizer fin.
Figure 3:
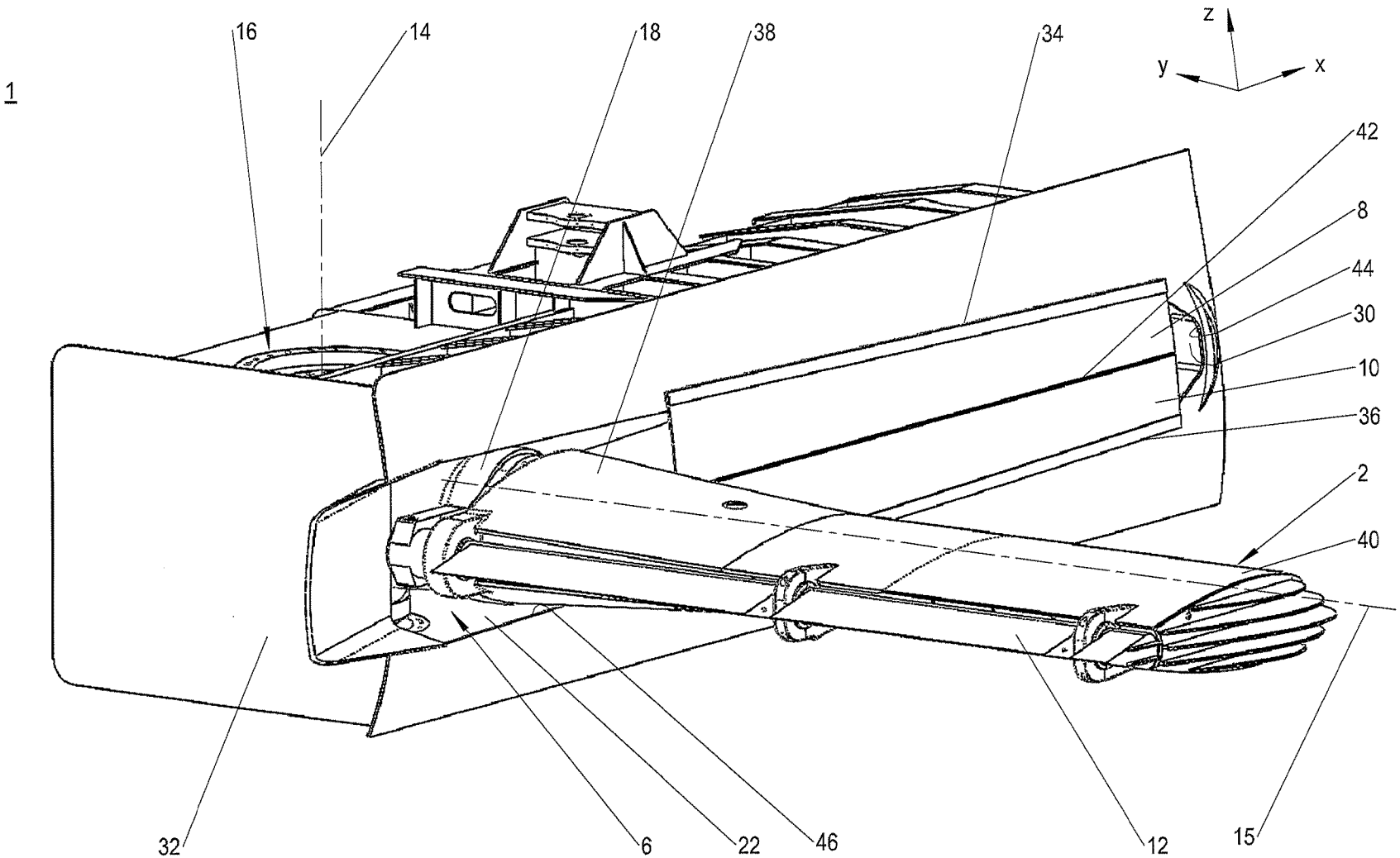
FIG. 3 shows a perspective depiction of the first exemplary embodiment with extended stabilizer fin.

In FIGS. 1 to 3 a first exemplary embodiment of an inventive fin stabilizer 1 for stabilizing a watercraft, in particular a ship, is shown in different operating states. Usually at least one fin stabilizer 1 is respectively laterally disposed on a ship amidships under water. While the fin stabilizer 1 in FIG. 1 is depicted with retracted stabilizer fin 2, it is shown in FIG. 2 with extending stabilizer fin 2 and in FIG. 3 with extended stabilizer fin.

In addition to the stabilizer fin 2 the fin stabilizer 1 has an essentially not-shown drive for pivoting the stabilizer fin 2, a receiving space 6 for receiving the retracted stabilizer fin 2, and two opening-side cover elements 8, 10. All exemplary embodiments two to nine described in the following FIGS. 1 to 16 include the same aforementioned features pivotable stabilizer fin 2, drive, and receiving space 6. There are variations only with respect to the cover element or cover elements 8, 10, which variants are described separately for FIGS. 4 to 16.

The stabilizer fin 2 here has a tail fin 12 that is deflected in or essentially in travel direction x of the ship downstream from it and adjustable relative thereto via a separate, not-shown drive. The stabilizer fin 2 is pivotable about its vertical axis 14, which here for fundamental simplicity extends in or essentially in the vertical direction z of the ship. In addition, the stabilizer fin 2 is rotatable about its longitudinal axis 15 by a defined angular range. In the retracted state shown in FIG. 1 the longitudinal axis 15 extends in or essentially in the longitudinal direction of the watercraft and thus in travel direction x. In the extended state shown in FIG. 3 the longitudinal axis 15 extends tranverse or essentially transverse to the travel direction x and thus in transverse direction y. The tail fin 12 is rotatable via a drive relative to the stabilizer fin 2 about its own longitudinal axis by a defined angular range.

The vertical axis 14 is formed by a swivel tower 16 of the fin stabilizer 1, which swivel tower 16 is disposed in the receiving space 6 and on whose pivot arm 18 extending transverse to the vertical axis 14 the stabilizer fin 2 is connected rotatably about its longitudinal axis 15.

The not-shown drive for pivoting the stabilizer fin 2 about the vertical axis 14 is a hydraulic drive, which is positioned outside the receiving space 6 and is in operative connection with the swivel tower 18 by hydraulic lines.

The receiving space 6 is the so-called fin box. It is box-shaped and closed or fluid-tight with respect to the hull interior. In addition to the receiving of the swivel tower 16 it serves for complete receiving of the stabilizer fin 2 including its tail fin 12 in the retracted state. It has an opening 22 facing the water as well as, viewed in vertical direction z, a cover wall, a base wall opposing the cover wall, a rear wall 28 opposing the opening 22 or fin-box opening viewed in transverse direction y, and, viewed in travel direction x a front wall 30 and a rear wall 32. For reasons of clarity only the front wall 30 and the rear wall 32 are numbered.

An at least one cover element 8, 10 that at least partially covers or closes an opening of the receiving space, through which opening 22 the pivotable stabilizer fin 2 enters and exits the receiving space 6 during retracting and extending. The cover elements 8, 10 serve for at least partial covering or closing of the opening 22 in the retracted state of the stabilizer fin 2 and in the extended state of the stabilizer fin 2.

In the first exemplary embodiment according to FIGS. 1 to 3 the cover elements 8, 10 are two passive and flexible plastic lips. In particular they are two elastic or ideally elastic rubber mats. An exemplary material is rubber. "Passive" means that for retracting and/or extending of the stabilizer fin 2 the cover elements 8, 10 are not themselves controlled but rather are transferred from their closed position into their open position exclusively by the stabilizer fin and automatically assume their closed position again due to their elastic material properties, without active controlling, after their retracting or extending. Their flexibility and the flexibility of all cover elements 8, 10 discussed in the following is set such that they withstand a water pressure that abuts on them externally and do not or nearly do not elastically yield, i.e., they are not or not appreciably pressed-in into the opening 22 by the water pressure either at anchor or during travel of the ship.

The cover elements 8, 10 have a rectangular design and are inherently stable, i.e., they require no supporting support structure. Viewed in vertical direction z they are attached at an upper edge section 34 or a lower edge section 36 and have such a height that over their entire length they close the opening 22 over its entire height. In the exemplary embodiment shown here they have the same height and thus each half the height of the opening 22.

In the retracted state shown in FIG. 1 they contact the opening centrally with or nearly centrally by their longitudinal edges and form there a linear contact region 42. They have at least such a length that the stabilizer fin is covered over its entire length from its fin base 38 numbered in FIG. 2 to the fin tip 40. In the exemplary embodiment shown here a front opening region 44 and a rear, pivot-tower-side opening region 46 remain free. Of course these opening regions 44, 46 can also be covered. However, it has been shown that the advantageous effect of the cover elements 8, 10 already shows when only the stabilizer fin 2 is covered over its entire length in the closed position as here.

With the extending of the stabilizer fin 2 the tail fin 12 passes through the contact region 42 and pushes the two cover elements 8, 10 apart. For this purpose it is advantageous if during extending the contact region lies at the height of the tail fin 12. During extending, the cover elements 8, 10 virtually brush over the stabilizer fins 2, wherein the cover elements 8, 10 are not controlled but rather the stabilizer fin 2 actively moves with respect to the passive cover elements 8, 10.

After the complete passing-through of the stabilizer fin 2, i.e., in the extended state of the stabilizer fin 2, the cover elements 8, 10 again assume their closed position due to their elastic material properties. As illustrated in FIG. 3, the cover elements 8, 10 again contact with their opposing longitudinal edges, thus forming the contact region 42 and partially closing the opening 22.

Figure 4:
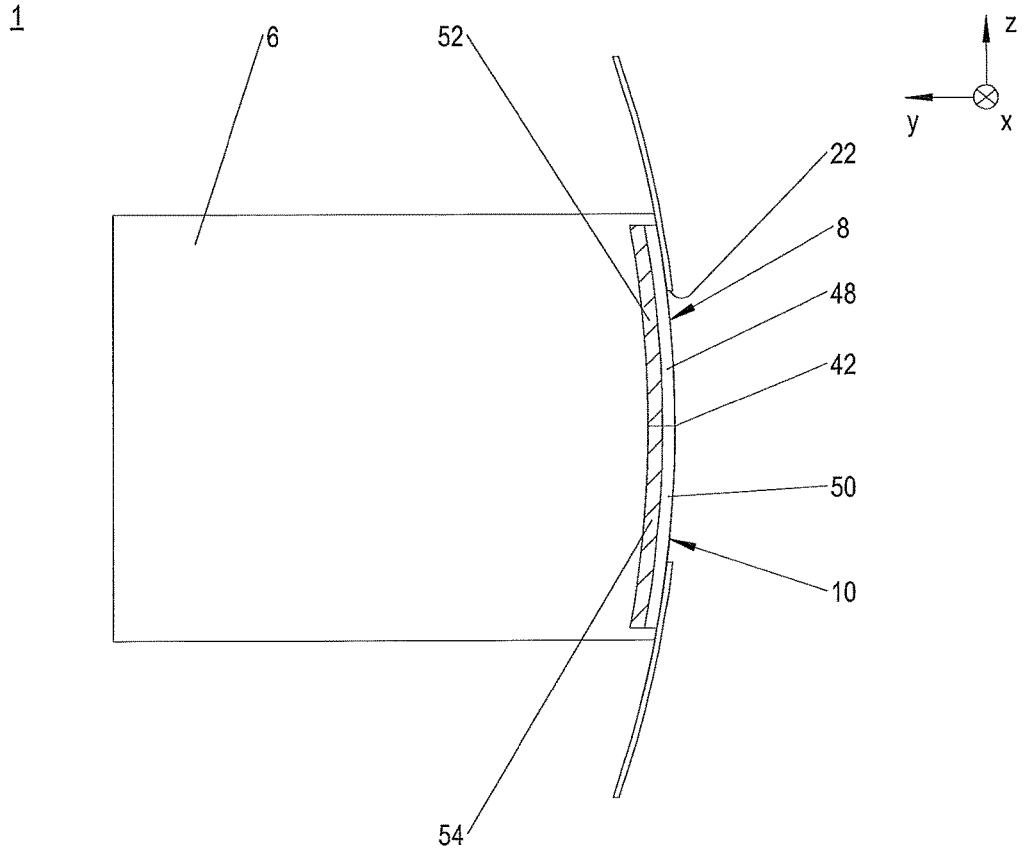
FIG. 4 shows a section through a receiving space with opening-side cover elements of a second exemplary embodiment of the inventive fin stabilizer.

In FIG. 4 a second exemplary embodiment of the inventive fin stabilizer 1 is shown. For reasons of clarity a stabilizer fin is not depicted. In contrast to the first exemplary embodiment according to FIGS. 1 to 3, two flexible cover elements 8, 10 are not inherently stable and elastic plastic lips or rubber mats, but rather elastic rubber mats 48, 50, which are stabilized in their closed position via elastic support elements such as spring elements 52, 54 attached here, for example, rear-side. The spring elements 52, 54 here are spring sheets extending extensively over the rubber mats 48, 50. Alternatively the spring elements 52, 54 can be individual spring strips and the like positioned adjacent to one another. Due to the lack of inherent stability of the rubber mats 48, 50, the cover elements 8, 10 are embodied thinner than in the first exemplary embodiment, whereby smaller bending radii can be achieved than in the first exemplary embodiment.

Figure 5:
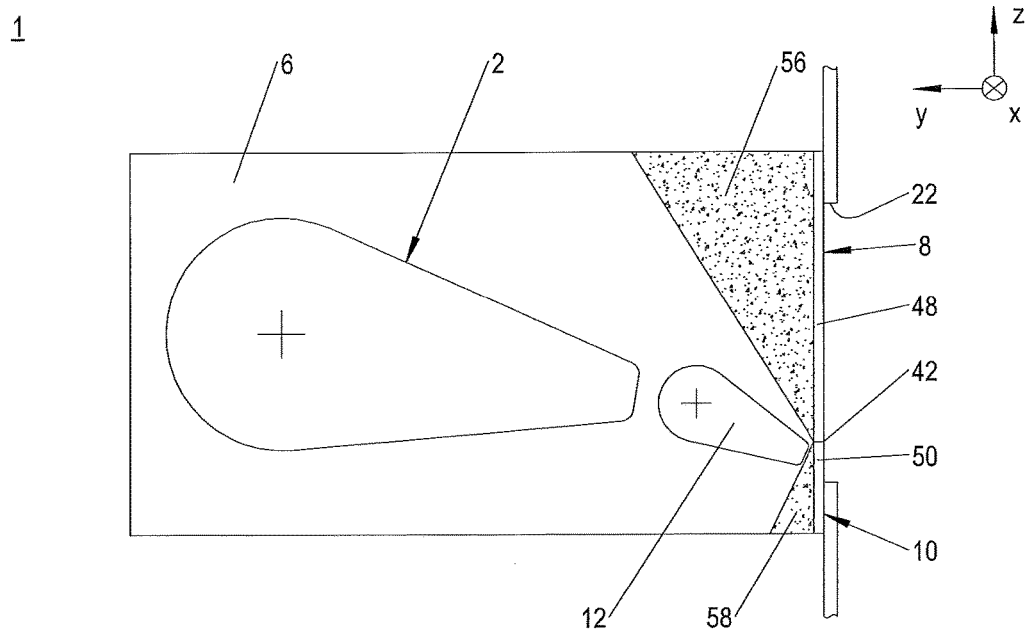
FIG. 5 shows a section through a receiving space with opening-side cover elements of a third exemplary embodiment of the inventive fin-stabilizer with depicted stabilizer fin.

In the third exemplary embodiment shown in FIG. 5 of the inventive fin stabilizer, in contrast to the second exemplary embodiment, two flexible plastic lips or rubber mats 48, 50 are not stiffened in their closed position via spring elements, but rather via volume-variable support elements such as sponge elements 56, 58. The sponge elements 56, 58 are disposed rear-side of the rubber mats 48, 58 and tapered wedge-shaped toward a contact region 42 of the rubber mats 48, 50 starting from their foot section attached to a cover wall or base wall of a receiving space 6 for a stabilizer fin 2. They are pore-like and such that they can absorb water and release water. During extending and retracting of the stabilizer fin 2 the water is pressed out of them by the stabilizer fin 2 running against them, with the result that they experience a volume reduction. However, after the extending of the stabilizer fin 2 they again draw water surrounding them and thus experience a volume increase until they have reached their original volume and thus their original shape according to their closed position. The third exemplary embodiment is thus also a passive system.

In contrast to the above-mentioned exemplary embodiments, in the third exemplary embodiment the lower cover element 10 is embodied with a lower height than the upper cover element 8. In direct comparison the upper cover element 8 is thus taller than the lower cover element 10. Of course, however, both cover elements 8, 10 can also have the same height. The height of the cover elements 8, 10 determines their longitudinal-edge-side contact region 42, which during extending preferably lies, like the tail fin 12, at the height of a first extending stabilizer-fin part or stabilizer-fin section. If the two cover elements 8, 10 now have a different vertical extension, this means that in the third exemplary embodiment the tail fin 12 extends to a different height than in the previous exemplary embodiments.

Figure 6:
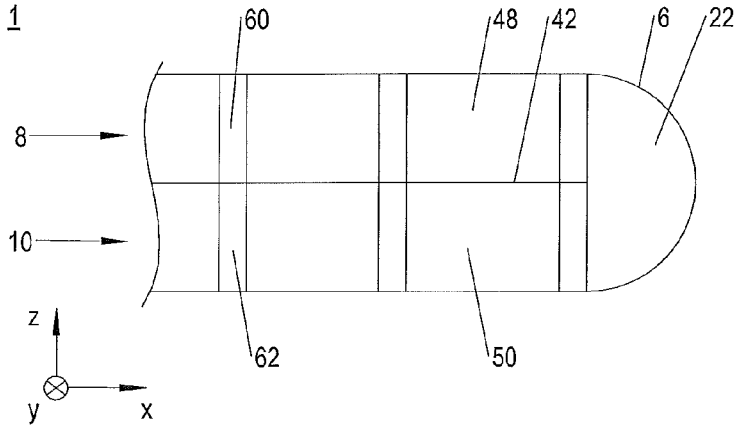
FIG. 6 shows a plan view of a receiving space with opening-side cover elements of a fourth exemplary embodiment of the inventive fin stabilizer.
Figure 7:
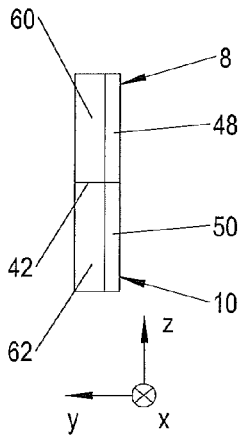
FIG. 7 shows a section through the fourth exemplary embodiment.

In FIGS. 6 and 7 a fourth exemplary embodiment of the inventive fin stabilizer 1 is shown with two flexible cover element 8, 10, which include elastic, not-inherently-stable rubber mats 48, 50 and rear-side volume-variable support elements 60, 62. In contrast to the third exemplary embodiment according to FIG. 5 the support elements are hollow-chamber ribs 60, 62. The hollow-chamber ribs 60, 62 extend in vertical direction z and are laterally spaced from each other in the longitudinal direction of the cover elements 8, 10. They are, for example, connected to an on-board compressed-air network of the ship and thereby pressurizable with compressed air.

For or during extending and retracting of the stabilizer fin 2 they are depressurized, wherein a fluid or pressure medium and in particular compressed air is passively pushed out by the water pressure surrounding it. The hollow-chamber ribs 60, 62 lose their inherent stability, and the rubber mats 48, 50 can be elastically deformed by the stabilizer fin 2.

For transferring the cover elements 8, 10 back in their closed position in the retracted state and in the extended state of the stabilizer fin, the hollow-chamber ribs 60, 62 are actively pressurized with the pressure medium such as compressed air until they again have their inherent stability. The fourth embodiment is thus an active-passive or a semi-passive system.

Figure 8:
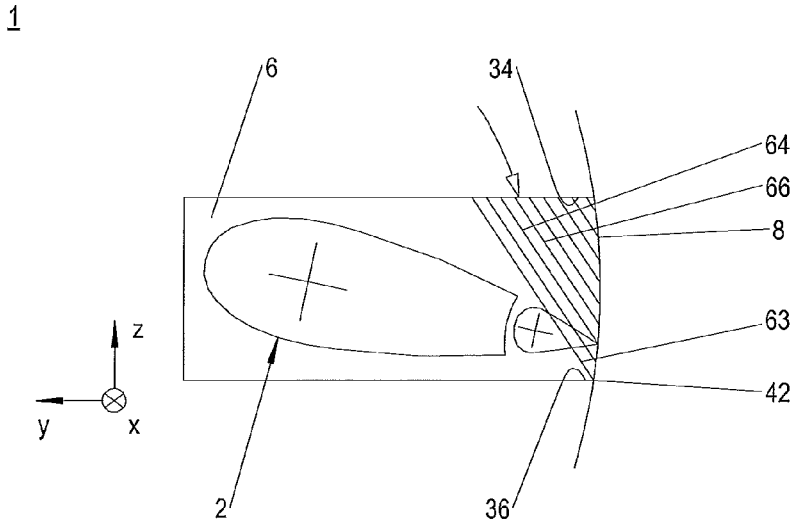
FIG. 8 shows a sectional depiction of a fifth exemplary embodiment of an inventive fin stabilizer with retracted stabilizer fin.
Figure 9:
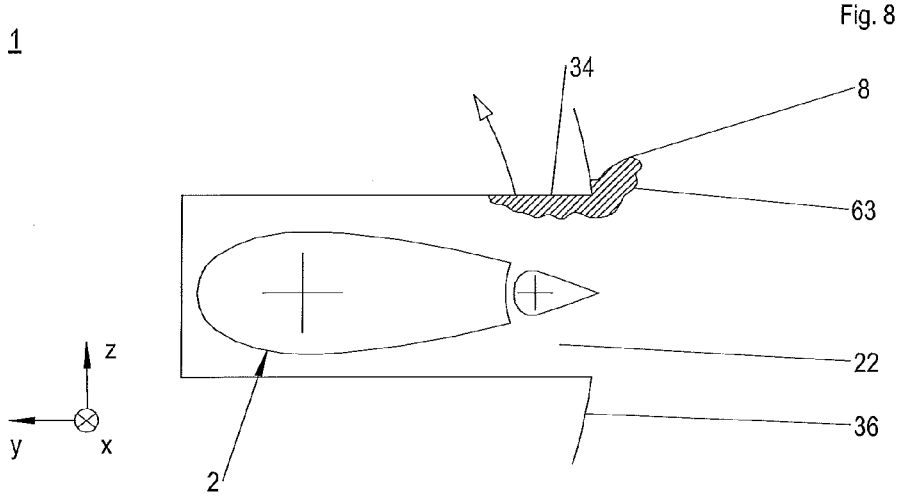
FIG. 9 shows a section through the fifth exemplary embodiment with extended stabilizer fin.
Figure 10:
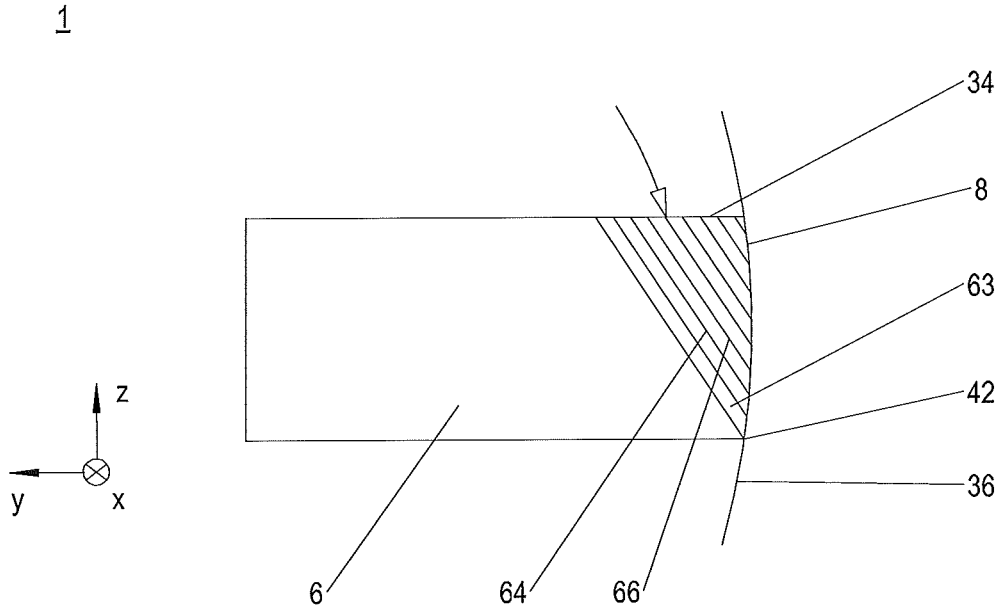
FIG. 10 shows a section through the fifth exemplary embodiment with omission of the stabilizer fin.

In FIGS. 8, 9, and 10 a fifth exemplary embodiment of the inventive fin stabilizer 1 is shown whose fin-box opening 22 is at least partially coverable in the retracted state of a stabilizer fin 2 (FIG. 8) and in the extended state of a stabilizer fin 2 (FIG. 10). For reasons of clarity the completely extended stabilizer fin 2 is not shown in FIG. 10.

In contrast to the aforementioned exemplary embodiments, the fifth exemplary embodiment includes only one flexible cover element. The cover element 8 here is a volume-variable hollow-chamber lip. The cover element designated as hollow-chamber lip 8 in the context of FIGS. 8, 9, and 10 has a wedge-shaped cross-section and is attached by its wide foot section to the upper edge section 34 of the opening 22. In the closed position shown in FIGS. 8 and 10 it extends over the entire height of the opening 22 and has a linear head section 63 by which it abuts on the lower edge section 36 of the opening. The hollow-chamber lip 8 in the pressurized state has a defined target-contour or -shape via flexible and high-tensile-strength shaping elements 64, 66 that are disposed in the interior of the hollow-chamber lip 8. The shaping elements 64, 66 are, for example, fabric sheets such as material sheets extending from the foot section to the head section 63, wherein holes for pressure equalization are introduced between chambers formed by them. For pressurizing the hollow-chamber lip 8 with a fluid or pressure medium such as compressed air it is in operating connection with a compressed-air source, for example, a shipboard network.

As shown in FIGS. 8 and 10 and additionally indicated by the arrow, the hollow-chamber lip 8 is inflated in its closed position. It then abuts with its head section 63 on the lower edge region 36 of the opening 22 and thus extends over the entire height of the opening 22. A longitudinal contact region 42 for at least partial closing of the opening 22 is thus formed between the head section 63 and the lower edge section 36. For reasons of clarity the entire extended stabilizer fin 2 is not shown in FIG. 10.

As additionally indicated in FIG. 9 by the arrow, the hollow-chamber lip 8 is depressurized for retracting or extending and thus virtually folded during pivoting. Here the head section 63 can briefly be moved out through the opening 22 out of the receiving space 6. The depressurization is preferably effected here automatically via the externally abutting water pressure, i.e., passively. The point in time for extending and retracting of the stabilizer fin 2 can be set such that it only extends or retracts starting from a certain pushed-out quantity of pressure medium from the at least one hollow-chamber lip 8 or an effected pressure buildup in the at least one hollow-chamber lip 8. Possible leaks in the hull of the hollow-chamber lip 8 can be immediately recognized via pressure fluctuations or pressure reductions during the pressurizing in the at least partially closed state.

After the retracting or extending, the hollow-chamber lip 8 is again pressurized with a pressure medium and thus transferred into its closed position shown in FIGS. 8 and 10, wherein it thus extends over the entire height of the opening 22 and at least partially closes it. Like the fourth exemplary embodiment the fifth exemplary embodiment is thus an active-passive or a semi-automatic system.

Figure 11:
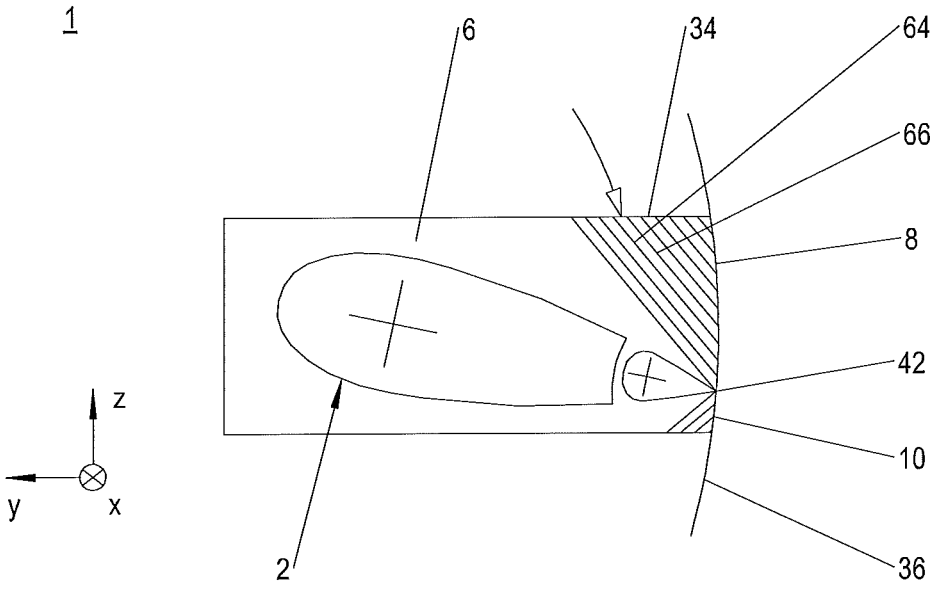
FIG. 11 shows a sectional depiction of a sixth exemplary embodiment of an inventive fin stabilizer with retracted stabilizer fin.
Figure 12:
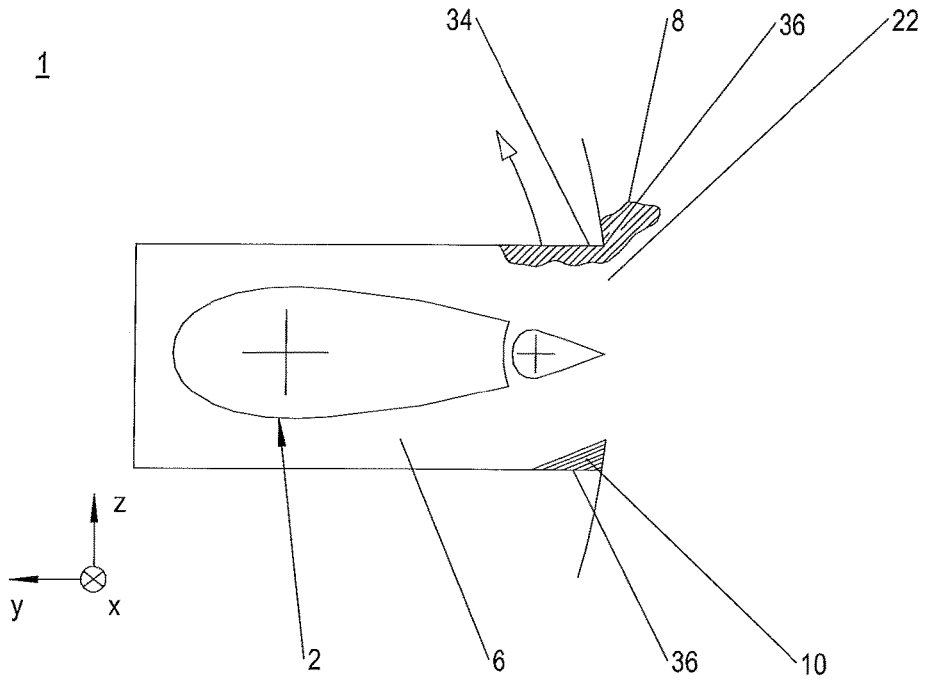
FIG. 12 shows a section through the sixth exemplary embodiment with extended stabilizer fin.
Figure 13:
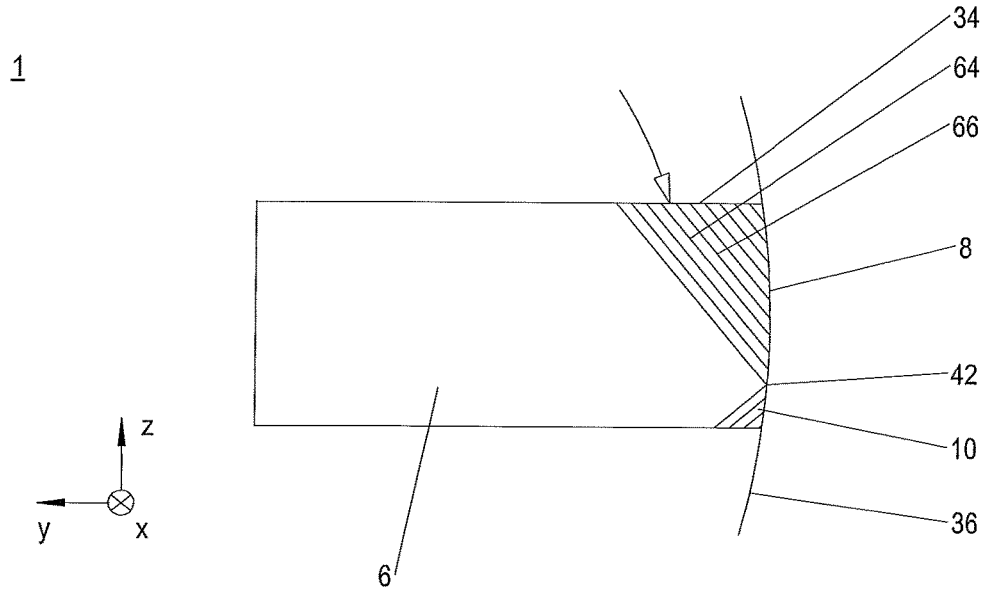
FIG. 13 shows a section through the sixth exemplary embodiment with omission of the stabilizer fin.

In FIGS. 11, 12, and 13 a sixth exemplary embodiment of the inventive fin stabilizer is shown whose fin-box opening 22 is at least partially coverable in the retracted state of a stabilizer fin 2 (FIG. 11) and in the extended state of a stabilizer fin 2 (FIG. 13). For reasons of clarity the completely extended stabilizer fin 2 is not shown in FIG. 13.

In contrast to the fifth exemplary embodiment, the sixth exemplary embodiment includes two flexible cover elements 8, 10 embodied as volume-variable hollow-chamber lips. The upper cover element 8, designated as upper hollow-chamber-lip in the context of FIGS. 11, 12, and 13, has a wedge shaped cross-section and is attached by a wide foot section to the upper edge section 34 of the opening 22. The lower cover element 10, designated as lower hollow-chamber lip in the context of FIGS. 11, 12, and 13, is also wedge-shaped and attached to the lower edge section 36 of the opening 22. In comparison the upper hollow-chamber lip 8 is embodied taller than the lower hollow-chamber lip 10.

As illustrated in FIGS. 11 and 13, in the closed position the two hollow-chamber lips extend together over the entire height of the opening 22. The height of the hollow-chamber lips 8, 10 and thus the position of their contact region 42 conforms with the position of the fin in the retracted state. The shaping of the upper hollow-chamber lip 8 and lower hollow-chamber lip 10 by flexible and high-tensile-strength shaping elements 64, 66, as well as the functionality or controlling of the hollow-chamber lips 8, 10 are like the functionality or controlling of the individual hollow-chamber lips shown in the fifth exemplary embodiment according to FIGS. 8, 9, 10.

Figure 14:
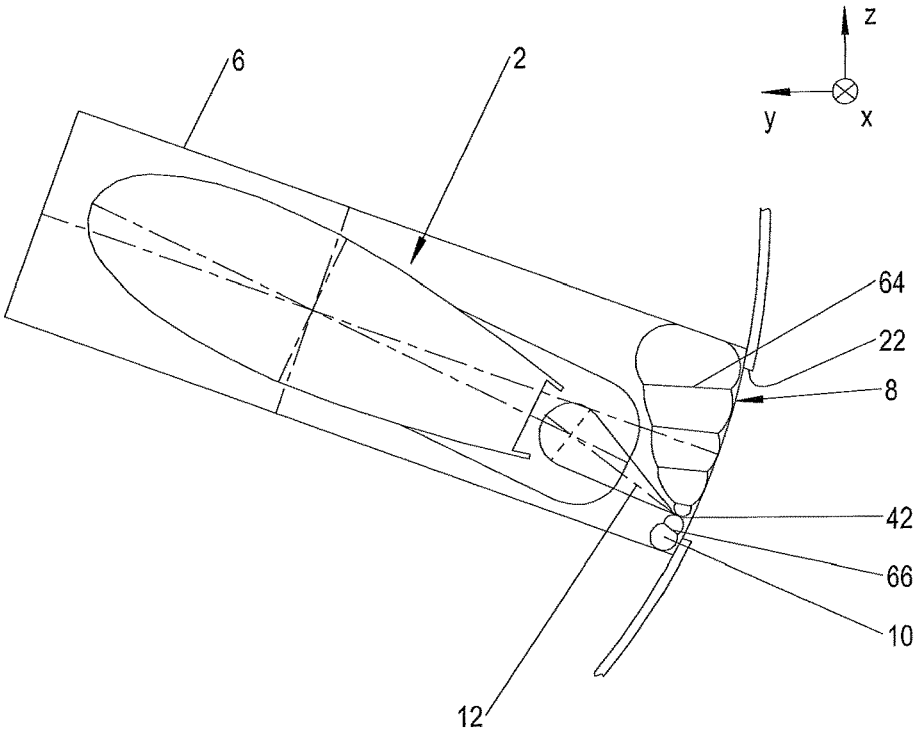
FIG. 14 shows a sectional depiction of a seventh exemplary embodiment of an inventive fin stabilizer with retracted stabilizer fin.

In FIG. 14 a seventh exemplary embodiment of the inventive flow stabilizer 1 is shown whose fin-box opening 22 is at least partially covered in the retracted state and in the extended state of a stabilizer fin 2.

Like the sixth exemplary embodiment according to FIGS. 11, 12, and 13, the seventh exemplary embodiment includes a lower and an upper hollow-chamber lip acting as flexible cover elements 8, 10. In the context of FIG. 14 the cover elements 8, 10 are designated as upper hollow-chamber lip 8 and lower hollow-chamber lip 10. The upper hollow-chamber lip 10 also has a lower height than the upper hollow-chamber lip 8, wherein their heights conform to the position of the retracted fin.

In contrast to the sixth exemplary embodiment the seventh exemplary embodiment includes flexible and volume-variable shaping elements 64, 66 for target-shaping under pressurization, which extend in the closed position transverse or essentially transverse to the vertical direction z. The shaping elements 64, 66 that are disposed in the interior of the hollow-chamber lips are, for example, fabric sheets or material sheets wherein holes are introduced for pressure equalization between chambers formed between them. For pressurizing the hollow-chamber lip with compressed air it is in operative connection with a compressed-air source, for example, a shipboard network. The functionality or controlling of the hollow-chamber lips is the same as the functionality or controlling of the two hollow-chamber lips in the sixth exemplary embodiment according to FIGS. 11, 12, and 13, and thus like the functionality or controlling of the individual hollow-chamber lips in the fifth exemplary embodiment according to FIGS. 8, 9, and 10.

Figure 15:
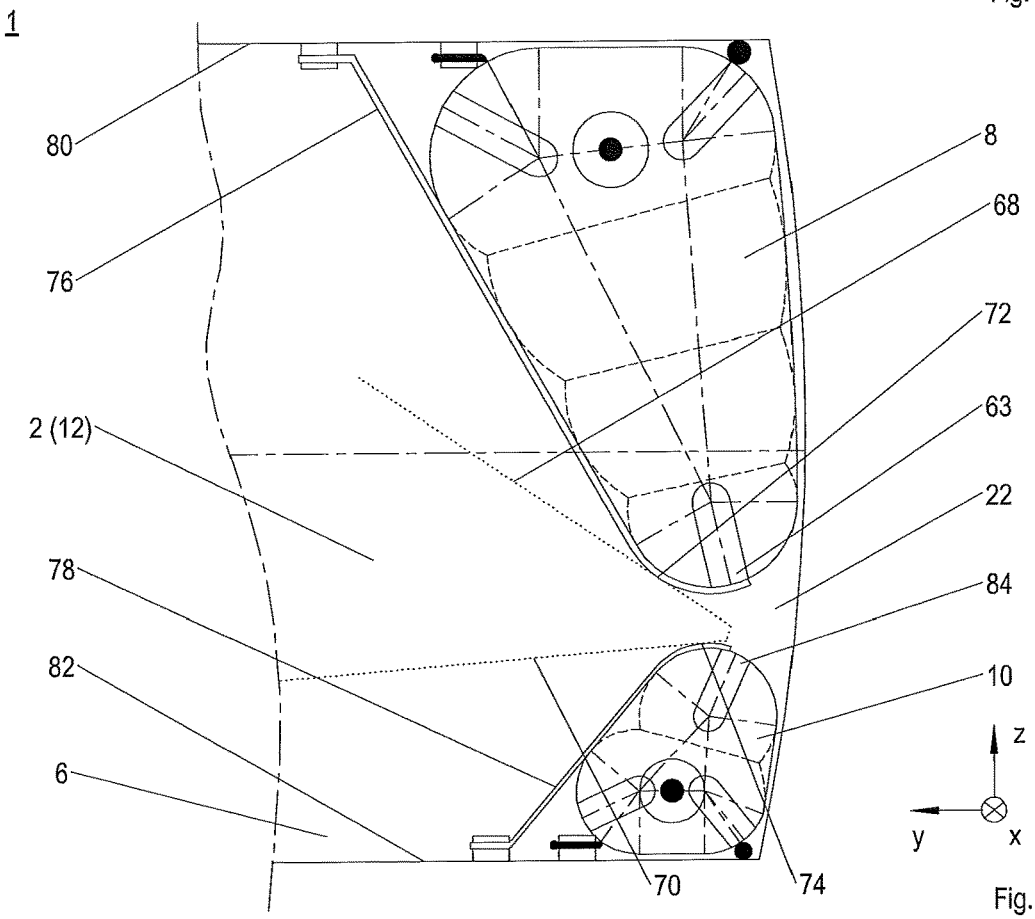
FIG. 15 shows a section through a receiving space with opening-side cover elements of an eighth exemplary embodiment of the inventive fin stabilizer.

An eighth exemplary embodiment 1 of the invention is shown in FIG. 15. In contrast to the preceding exemplary embodiments, in the retracted state of a stabilizer fin 2 a section of the stabilizer fin 2 or of a tail fin 12 protrudes through an upper cover element 8 and through a lower cover element 10. However, in the retracted state the stabilizer fin 2 does not protrude out over the opening 22 of the receiving space 6, but rather is completely received therein. Here the cover elements 8, 10 abut on opposing sides 68, 70 of the stabilizing fin 2 and thus each form a sealing contact region 72, 74 with the stabilizing fin 2. In the retracted state the cover elements 8, 10 thus form no contact region 42 with each other, rather each its own contact region 72, 74 with the stabilizer fin 2. In particular in this exemplary embodiment the cover elements 8, 10 abut on the sides 68, 70 via robust flexible elements, such as, for example, belt elements 76, 78 to be explained in the following. However, the belt elements 76, 78 are optional.

In the extended state the cover elements 8, 20 can form a contact region between each other, however this depends on their shape and/or the belt elements 76, 78 shown here.

As in the seventh exemplary embodiment the cover elements 8, 10 are embodied here as hollow-chamber lips and are also designated as such in the following in FIG. 15. In contrast to the seventh exemplary embodiment, however, at least one belt element 76, 78 respectively extends rear-side of the hollow-chamber lips 8, 10. The belt elements 76, 78 are robust and simultaneously elastic or flexible, for example in the form of conveyor bands. The upper belt element here is attached to a cover wall section 80 of the receiving space 6 and engages on the head section 63 of the upper hollow chamber lip 8. The lower belt element 78 is attached to a base wall section 82 of the receiving space 6 and engages on the head section 84 of the lower hollow-chamber lip. The belt elements 76, 78 are rubber-like or elastic and preferably extend over the entire length of the hollow-chamber lips 8, 10. On the one hand the belt elements 76, 78 represent a protection of the hollow-chamber lips 8, 10, in particular with retracting and extending of the stabilizing fin 2. Then it is prevented by the belt elements 76, 78 that the stabilizing fin 2, whose sides 68, 70 are roughened due to, for example, natural infestation with barnacles in the course of operation, scrubs along the hollow-chamber lips 8, 10 and damages them. On the other hand the belt elements 76, 78 act as a guide or as a hinge during depressurization of the hollow-chamber lips 8, 10.

Figure 16:
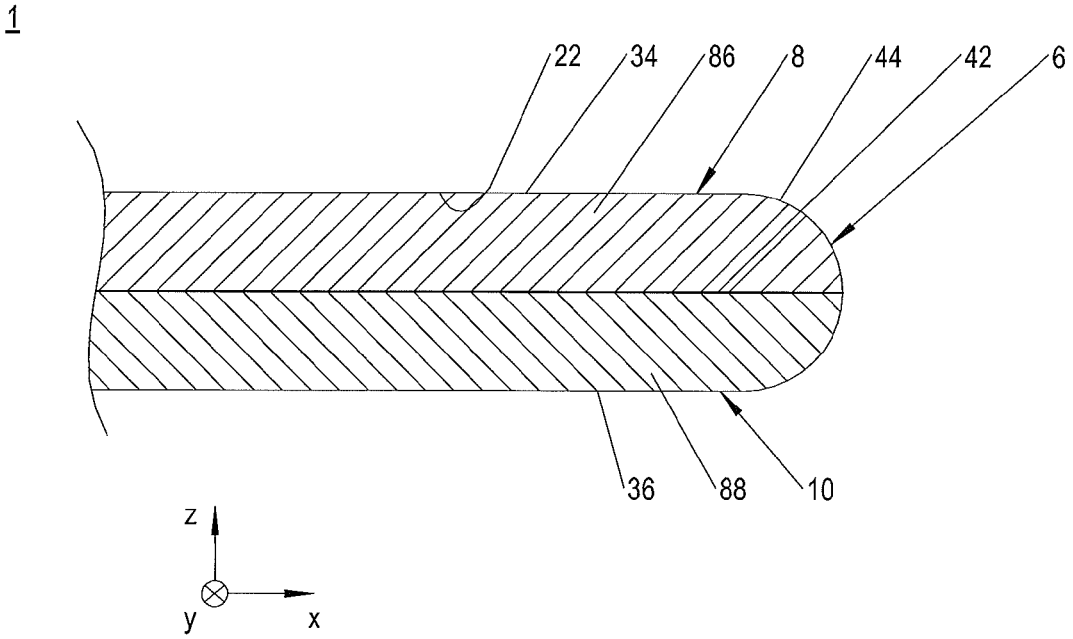
FIG. 16 shows a plan view of a receiving space with opening-side cover elements of a ninth exemplary embodiment of the inventive fin stabilizer.

In FIG. 16 a ninth exemplary embodiment of the inventive fin stabilizer is shown including two passive flexible cover elements 8, 10 for at least sectional covering of a fin-box opening 22. The cover elements 8, 10 respectively comprise a variety of flexible and inherently stable strip elements 86, 88, belt elements, bristles, lamellae, and the like. The opposing strip elements 86, 88 of the cover elements 8, 10 form a linear contact zone 42 through which the stabilizer fin passes-through during retracting and extending. The strip elements 86, 88 are attached to the upper or lower edge region 34, 36 of the opening 22 and extend here over the respective half opening height. In combination they cover the entire opening height. In contrast to the preceding exemplary embodiments a front opening region 44 is also closed by the strip elements 86, 88. The strip elements 86, 88 are pushed apart from each other or pushed away by the retracting or extending stabilizer fin 2 and after the complete passage again assume their closed position shown in FIG. 16, wherein the opening 22 is at least sectionally covered. The ninth exemplary embodiment is thus a passive system.

In all exemplary embodiments a vertical covering of the opening is achieved in the region of the stabilizer fin 2, whereas laterally to the stabilizer fin 2 the opening is open or laterally not-closed opening regions 44, 46 are formed, with the exception of the ninth exemplary embodiment in FIG. 16, wherein the opening 22 front region is also closed. Of course a vertical gap can thus also be formed between the cover elements 8, 10 in at least the retracted state of the stabilizer fin 2; the cover elements 8, 10 can thus also form no contact region 42. It is essential that the opening 22 is closed in a larger region than open, in the vertical direction over the length of the at least one cover element 8, 10, by the at least one cover element 8, 10. The height of the at least one cover element 8, 10 is thus greater than a remaining, unclosed height of the opening 22 or a vertical gap over the length of the at least one cover element 8, 10. The at least one cover element 8, 10 can thus also only extend nearly over the respective height of the opening. An upper cover element 8 and a lower cover element 10 can thus together extend also only nearly over the respective height of the opening 22.

In addition, even if not respectively explicitly described, in some exemplary embodiments the cover elements can be actively opened and closed in a controlled or regulated manner, with the result that a cover system of the invention designated as passive can be embodied or be semi-passive or active.

Figure 17:
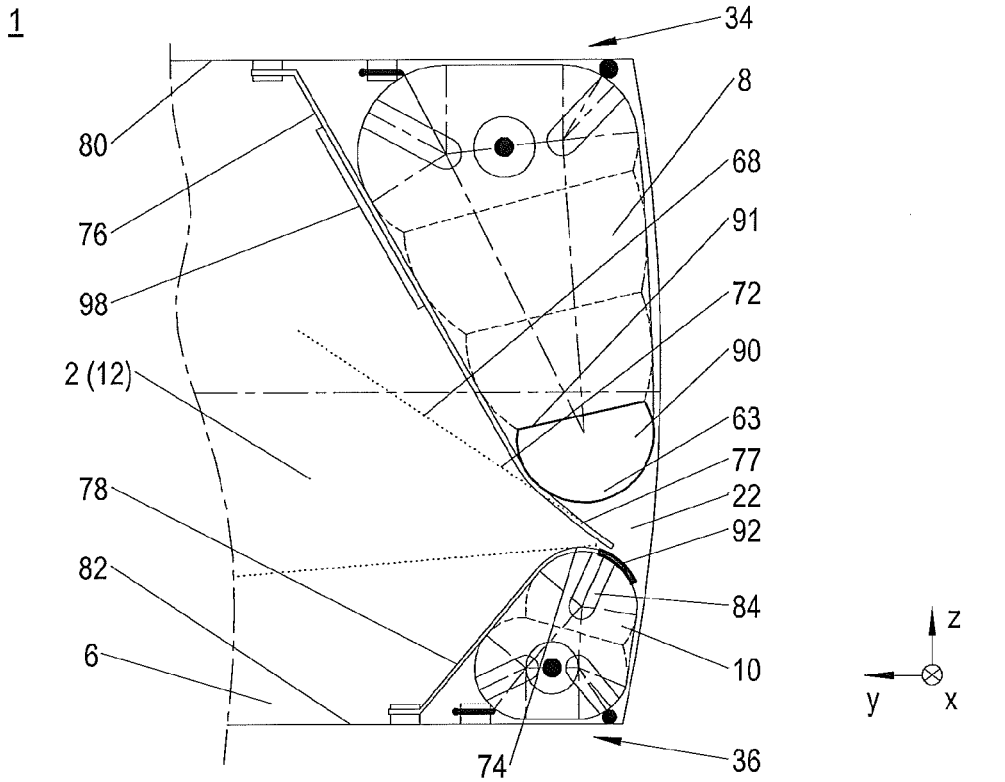
FIG. 17 shows a sectional depiction of a tenth exemplary embodiment of an inventive fin stabilizer with retracted stabilizer fin.

Like the eighth exemplary embodiment according to FIG. 15 the tenth exemplary embodiment shown in FIG. 17 includes a lower and upper hollow-chamber lip acting as flexible cover elements 8, 10, which are each provided with a belt element 76, 78. In the context of FIG. 15 the cover elements 8, 10 are designated as upper hollow-chamber lip 8 and lower hollow-chamber lip 10. The lower hollow-chamber lip 10 also has a lower height than the upper hollow-chamber lip 8, wherein their heights conform to the position of the retracted fin 2.

In contrast to the eighth exemplary embodiment according to FIG. 15, the tenth exemplary embodiment includes a buoyancy element 90 on the upper hollow-chamber lip 8. The buoyancy element 90 here can be a liquid-filled space integrated into the hollow-chamber lip 8, which is preferably drainable, a foam, such as, for example, polystyrene and the like. It is critical that it has a lower density than the water surrounding the hollow-chamber lip 8. In the exemplary embodiment shown here the buoyancy element 90 is a space 90 fillable with a gas, which space 90 is separated from the remaining volume of the hollow-chamber lip 8 by a partition 91 and is disposed end-side or, according to the representation in FIG. 17, below in the hollow-chamber lip 8. Here the buoyancy element 90 can also be disposed at any other position inside the hollow-chamber lip 8.

Furthermore, the tenth exemplary embodiment of the fin stabilizer includes a downward force providing element 92, which weights the at least one lower cover element 10. According to the exemplary embodiment the downward force providing element 92 is disposed on or in the belt element 78 in the region of the head section 84 and is embodied in the shape of a bent, in particular metallic, plate. The downward force providing element 92 here is virtually an extension of the belt element 78 and is supported on the cover element 10. The downward force providing element 92 weights the hollow-chamber lip 10 and pushes it after, or during, its depressurization downward out of the fin-box opening 22. In addition to the design as a bent metal plate, another geometry or another material can be used. Thus the downward force providing element 92 can also be integrated into the hollow-chamber lip 10, for example, as round steel, or be a space inside the hollow-chamber lip 10 filled with a material. It is critical that the downward force providing element 92 has a greater density than the water surrounding the hollow-chamber lip 8. The downward force providing element 92 can be a weight. Since the assembly can include at least one downward force providing element 92, the assembly can include at least one weight.

Complementary to the eighth embodiment according to FIG. 15 at least one of the belt elements 76 is provided with a reinforcement 98. This reinforcement 98 can be effected, for example, by a thick-walled rubber mat with further local reinforcements. This reinforcement 98 can be embodied with different stiffness depending on the requirement. In particular with steeply installed fin boxes 6 the reinforcing can favor pivoting-out of the hollow-chamber lip 8. With an extending of the stabilizing fin 2 the at least one belt element 76 can guide the cover element 8 out of the fin box 6 alone or with the reinforcement 98 and/or the buoyancy body 90, whereby in particular with steep installation angles of the fin stabilizer a jamming of the cover element 8 between the fin boxes 6 and the stabilizer fin 2, as well as a possible pivoting directed inward into the fin box 6 can effectively be prevented. According to the exemplary embodiment the at least one belt element 76 preferably only sectionally follows the geometry of the hollow-chamber lip 8. According to the exemplary embodiment in the retracted state of the fin 2 the belt element 76 lifts off from the hollow-chamber lip 8 and extends by its end section 77 out over the opening region 22 toward the lower hollow-chamber lip 10. Thus a possible gap between both cover elements 8, 10 can be closed by the at least one belt element 76 in the opening region. The at least one belt element 76 here can also form a protrusion or overlap in the opening region, which protrusion or overlap extends out over the lower hollow-chamber lip 10. The belt elements 76, 78 ensure the pivotable stabilizer fin 2, 12 does not contact the at least one cover element 8, 10 when shifting from the retracted state to the extended state.

Figure 18:
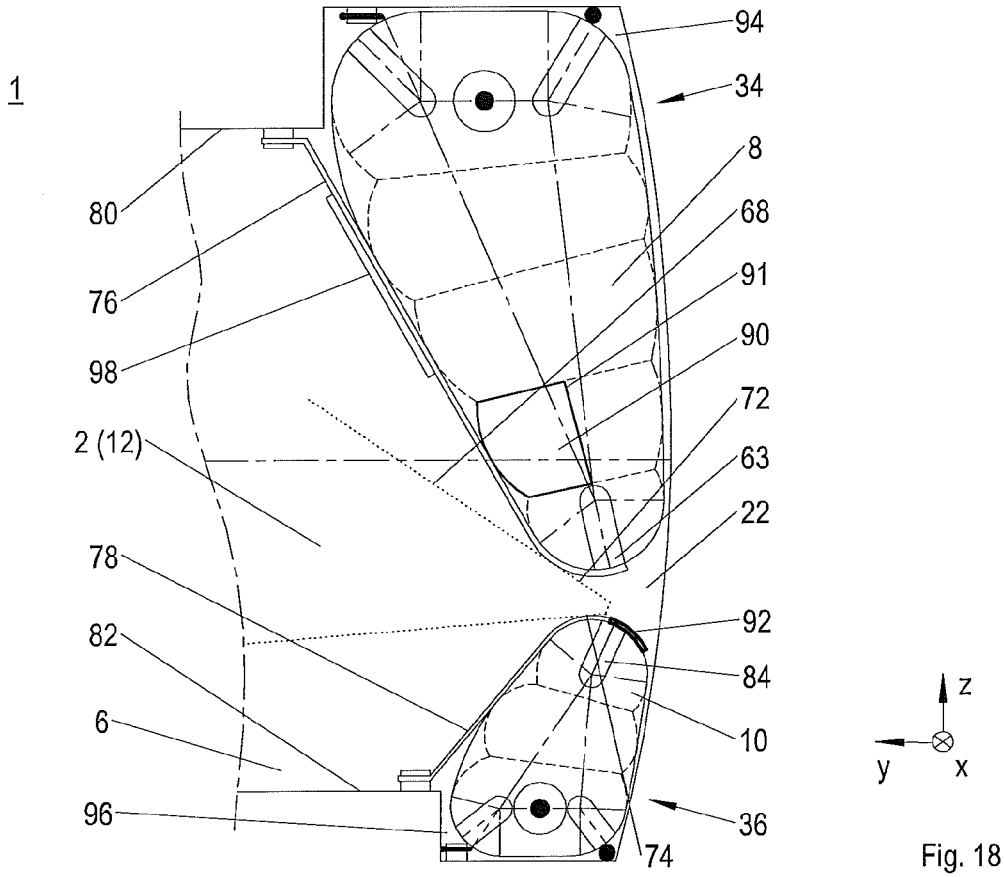
FIG. 18 shows a sectional depiction of an eleventh exemplary embodiment of an inventive fin stabilizer with retracted stabilizer fin.

FIG. 18 represents an eleventh exemplary embodiment of the inventive fin stabilizer 1. While the exemplary embodiments according to FIGS. 1 to 17 are in particular also suited to technically simple retrofitting, the eleventh exemplary embodiment shown in FIG. 18 describes in particular a solution for new ship construction. Complementary to the tenth exemplary embodiment according to FIG. 17 the eleventh exemplary embodiment provides a possibility of stowage of the cover element in the open state of the fin box 6. The buoyancy body 90 is disposed here approximately centrally in the upper hollow-chamber lip 8. In the upper edge section 34 the fin box 6 includes an upper receiving space 94 for receiving an upper hollow-chamber lip 8 in the open state. During extending of the stabilizer fin 2 the belt element 76 pivots over the upper receiving space 94 and preferably closes it. Thus the upper hollow-chamber lip 8 is protected from damage. In an analogous manner to the exemplary embodiment shown in FIG. 17 the belt element 76 can also include the end section 77 here.

In an analogous manner to the upper edge section 34, according to the eleventh exemplary embodiment the fin stabilizer includes an optional lower receiving space 96 in the region of the lower edge section 36, which lower receiving space 96 can receive the lower hollow-chamber lip 10. In the open state the belt element 78 can also close here such that the lower receiving space 96 is closed by the belt element 78 and protects the lower hollow-chamber lip 10. Reinforcements of the belt element 78 are also possible here.

Disclosed is a fin stabilizer for the stabilizing of watercraft, including a pivotable stabilizer fin, including a fin box for receiving the stabilizer fin in the retracted state and including at least one cover element for at least partial covering of a fin-box opening, through which the stabilizer fin enters in the fin box or exits during retracting and extending, wherein the at least one cover element is flexible, a cover element for a fin-box opening, and a watercraft including at least one fin stabilizer.

REFERENCE NUMBER LIST

1 Fin stabilizer
2 Stabilizer fin
6 Receiving space/fin box
8 Upper cover element
10 Lower cover element
10 Tail fin
14 Vertical axis
15 Longitudinal axis
16 Swivel tower
18 Swivel arm
22 Opening/fin-box opening
30 Front wall
32 Rear wall
34 Upper edge section
36 Lower edge section
38 Fin base
40 Fin tip
42 Contact region
44 Front opening region
46 Rear opening region
48 Rubber mat
50 Rubber mat
52 Spring element/support element
54 Spring element/support element
56 Sponge element
58 Sponge element
60 Hollow-chamber ribs
62 Hollow-chamber ribs
63 Head section
64 Shaping element
66 Shaping element
68 Side
70 Side
72 Contact region
74 Contact region
76 Belt element
77 End section
78 Belt element
80 Cover wall section
82 Base wall section
84 Head section
86 Bristle- or lamella-type element
88 Bristle- or lamella-type element
90 Buoyancy element
91 Partition
92 Downward force providing element
94 Upper receiving space
96 Lower receiving space
98 Reinforcement

The invention claimed is:

1. A fin stabilizer for stabilizing watercraft, including:

a pivotable stabilizer fin;

a receiving space for receiving the pivotable stabilizer fin, the pivotable stabilizer fin being shiftable from a retracted state in which the pivotable stabilizer fin is received in the receiving space to an extended state in which the pivotable stabilizer fin extends from the receiving space; and an at least one cover element that at least partially closes an opening of the receiving space, through which opening the pivotable stabilizer fin enters and exits the receiving space during retracting and extending, respectively, wherein the at least one cover element is flexible, and wherein the pivotable stabilizer fin does not contact the at least one cover element when shifting from the retracted state to the extended state.

2. The fin stabilizer according to claim 1, wherein when covering the opening, the at least one cover element extends over an entire height of the opening or nearly over the entire height of the opening.

3. The fin stabilizer according to claim 1, wherein the at least one cover element comprises a first cover element and a second cover element, and, when covering the opening, the first cover element and second cover element in combination extend over the entire height of the opening or nearly over the entire height of the opening.

4. The fin stabilizer according to claim 1, wherein the at least one cover element comprises a first cover element and a second cover element, and in the retracted state the first cover element and second cover element abut on opposing sides of the pivotable stabilizer fin.

5. The fin stabilizer according to claim 1, wherein the at least one cover element is an inherently stable and elastic plastic lip.

6. The fin stabilizer according to claim 1, wherein the at least one cover element are elastic plastic lips that are stabilized by at least one volume-variable support element.

7. The fin stabilizer according to claim 1, wherein the at least one cover element includes a plurality of inherently stable and elastic bristle elements or lamella elements.

8. The fin stabilizer according to claim 1, wherein the at least one cover element is a volume-variable hollow-chamber lip.

9. The fin stabilizer according to claim 8, wherein the hollow-chamber lip includes at least one flexible and high-tensile-strength shaping element.

10. The fin stabilizer according to claim 8, wherein the hollow-chamber lip is protected from a direct physical contact with the pivotable stabilizer fin by a belt element.

11. The fin stabilizer according to claim 8, wherein the at least one cover element includes at least one buoyancy body for generating a buoyancy.

12. The fin stabilizer according to claim 8, wherein the at least one cover element is weighted by at least one downward force providing body, wherein the downward force providing body is configured to generate a downward force.

13. The fin stabilizer according to claim 8, the at least one cover element comprising an upper cover element and a lower cover element, wherein an upper edge region of the fin box includes an upper receiving space for receiving at least one of the upper cover element and a lower edge region of the fin box includes a lower receiving space for receiving the lower cover element.

14. A flexible cover element for a fin stabilizer according to claim 1.

15. A watercraft including at least one fin stabilizer according to claim 1.

16. The fin stabilizer according to claim 1, wherein the at least one cover element includes at least one float configured to generate a buoyancy and at least one downward force providing body configured to generate a downward force.

17. The fin stabilizer according to claim 5, wherein the at least one cover element is an elastic plastic lip that is stabilized by at least one elastic or volume-variable support element, wherein the at least one cover element includes a plurality of inherently stable and elastic bristle elements or lamella elements, wherein the at least one cover element includes a volume-variable hollow-chamber lip having at least one flexible shaping element, and wherein the hollow-chamber lip is protected from a direct physical contact with the pivotable stabilizer fin by a belt element.

18. A fin stabilizer configured to stabilize a watercraft, the fin stabilizer including:

a housing defining a receiving space and an opening into the receiving space;

a pivotable stabilizer fin;

the pivotable stabilizer fin being shiftable from a retracted state in which the pivotable stabilizer fin is received in the receiving space to an extended state in which the pivotable stabilizer fin extends from the receiving space; and an at least one cover element that at least partially closes an opening of the receiving space, through which opening the pivotable stabilizer fin enters and exits the receiving space during retracting and extending, respectively, wherein the at least one cover element is flexible, and wherein the pivotable stabilizer fin does not contact the at least one cover element when shifting from the retracted state to the extended state.

19. The fin stabilizer according to claim 18, wherein the at least one cover element includes at least one float configured to generate a buoyancy and at least one downward force providing body configured to generate a downward force.

* * * * *